US006843737B1

(12) United States Patent
Smith et al.

(10) Patent No.: US 6,843,737 B1
(45) Date of Patent: Jan. 18, 2005

(54) GOLF BALL AND TEE SETTING DEVICE AND METHODS

(75) Inventors: Jay L. Smith, 4465 Highland Dr., Carlsbad, CA (US) 92008; William A. Dickerman, San Diego, CA (US); Franklyn D. Smith, Reno, NV (US)

(73) Assignee: Jay L. Smith, Carlsbad, CA (US)

( * ) Notice: Subject to any disclaimer, the term of this patent is extended or adjusted under 35 U.S.C. 154(b) by 0 days.

(21) Appl. No.: 10/627,146

(22) Filed: Jul. 25, 2003

(51) Int. Cl.[7] ..... A63B 57/00
(52) U.S. Cl. ..... 473/386
(58) Field of Search ..... 473/386; 294/19.1, 294/19.2

(56) References Cited

U.S. PATENT DOCUMENTS

| | | | | | |
|---|---|---|---|---|---|
| 4,589,661 | A | * | 5/1986 | Attig | 473/386 |
| 5,205,598 | A | * | 4/1993 | Miller | 473/386 |
| 5,330,178 | A | * | 7/1994 | Geishert, Sr. | 473/386 |
| D368,748 | S | * | 4/1996 | Kellersohn | D21/789 |
| 5,540,432 | A | * | 7/1996 | Keller | 473/386 |
| 6,723,010 | B2 | * | 4/2004 | Gill | 473/386 |

* cited by examiner

*Primary Examiner*—Steven Wong
(74) *Attorney, Agent, or Firm*—Duckor Spradling Metzger & Wynne

(57) ABSTRACT

According to the disclosed embodiments of the present invention, there is provided a device and method for setting a golf ball and tee, including a ball and tee receiving member disposed at the bottom end portion of a shaft. A ball engageable member is disposed at the lower end portion of the shaft for pressing the ball against the tee when the ball is received by the receiving member. The receiving member has a lower tee engageable member having a shallow slot opening extending radially in a direction to receive the tee within the slot. A hand engageable lever actuator extends radially from the upper end portion of the shaft in an opposite direction to the opening of the slot for actuating the movable ball engageable member to cause it to move away from the ball. The receiving member has a massive portion disposed substantially below and substantially opposite the actuator to cause the center of gravity of the device to be disposed offset from the shaft and the slot so that when the device is held by the actuator and the ball engageable member retracts away from the ball, the receiving member tends to swing away from the tee to disengage the tee from the shallow slot.

5 Claims, 1 Drawing Sheet

FIG. 1
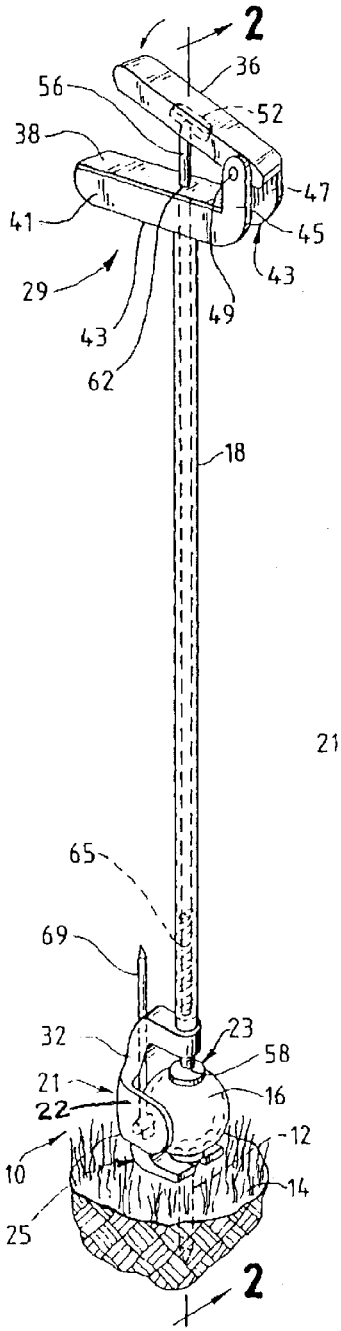
FIG. 2
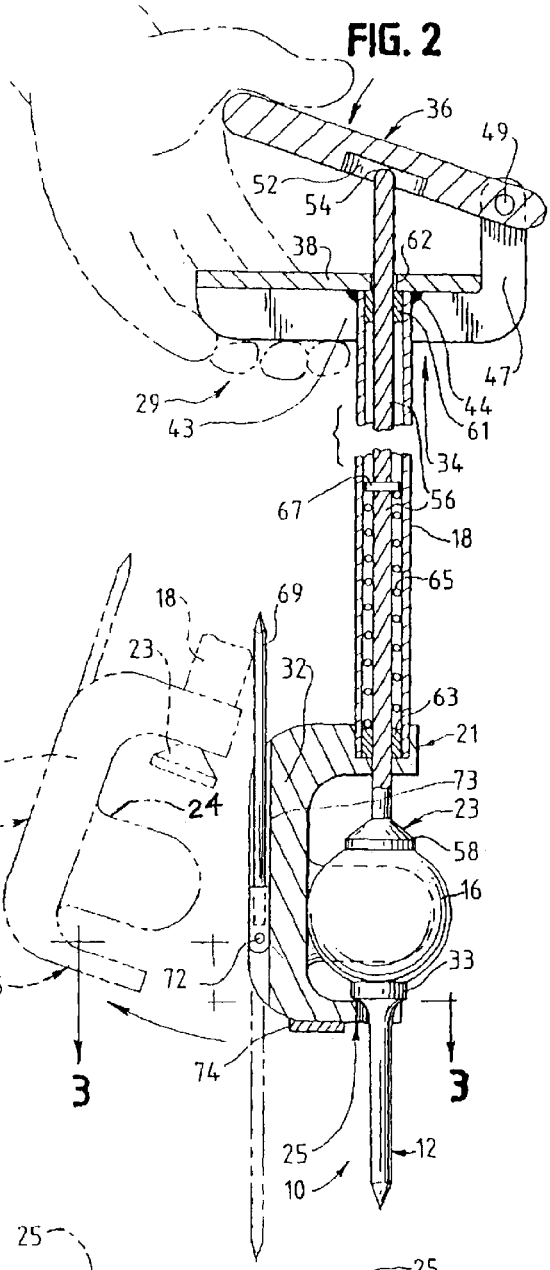
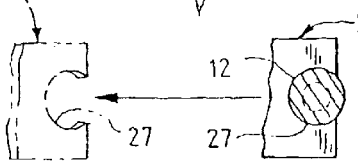
FIG. 3

GOLF BALL AND TEE SETTING DEVICE AND METHODS

FIELD OF THE INVENTION

The present invention relates in general to a golf ball and golf tee setting device and a method of using it. It more particularly relates to such a device and method to facilitate the setting of a tee into the ground with a ball on top of it, without causing the user to bend over at the waist.

BACKGROUND ART

There have been a variety of different types and kinds of devices attempting to facilitate the setting or placement of a golf tee into the ground with a golf ball on top of it without having to bend at the waist. For example, reference may be made to the following patents and patent application:

| U.S. Pat. No. | Inventor |
|---|---|
| 2,609,198 | Armstrong |
| 5,759,117 | Erickson, Jr. |
| 5,330,178 | Geishert, Sr. |
| U.S. Pub. No. 2003/0069090 A1 | Gill |
| 5,080,357 | Wolf |
| 4,526,369 | Phelps |
| 4,949,961 | Milano |
| 4,969,646 | Tobias |
| 5,310,177 | Conrad, et al. |
| 4,589,661 | Attig |
| Des. 368,748 | Kellersohn |
| Des. 322,644 | Murphy |
| Des. 300,761 | Bury |
| WO 01/28642 | Raeburn, et al. |
| WO 00/44448 | Liebenguth |

The foregoing U.S. patents and patent application 006909; U.S. Pat. Nos. 5,080,357; 4,526,369; 4,949,961 and 4,589,661 disclose golf ball and tee setting devices having moveable jaws for grasping the ball and the tee. The application and patents 0069090; U.S. Pat. Nos. 4,526,369 and 4,589,661 disclose a moveable lower jaw that swings downwardly away from the ball to release the tee once it is driven into the ground so that the device can be removed from the ball and the tee. However, it appears that it would not always be possible to drive the tee very deeply into the ground, since the lower jaw must swing downwardly away from the tee and the ball. Also, after the lower jaw swings away from the tee, the device is then moved vertically and it would appear that the lower jaw could then inadvertently dislodge the ball from the tee if the user did not carefully move the device upwardly and have the lower jaw move past the ball and the tee.

The U.S. Pat. Nos. 2,609,198; 4,969,649 and 5,310,177 disclose a golf ball and tee setting or positioning device which includes a clamping device, which does not include a lower moveable jaw. Instead, such as the device disclosed in patent 2,609,198, an upper ball clamping member moves vertically away from the ball, and then the user must carefully move a lower member horizontally away from the tee. The lower member includes a tee receiving elongated notch. However, due to the elongated notch, the notched member could cause the ball to be dislodged from the tee, unless the user acted with deliberate and careful movements. It is noted that, for example, U.S. Pat. No. 2,609,198, the tee setting device is designed to be held and moved by both hands of the user apparently to enable precise control of the movement of the device, so that deliberate and careful movements of the device can be executed.

BRIEF DESCRIPTIONS OF THE DRAWINGS

The following is a brief description of the drawings:

FIG. 1 is a pictorial view of a golf ball and tee setting device;

FIG. 2 is an enlarged sectional fragmentary view of FIG. 1 taken substantially on line 2—2 thereof; and FIG. 3 is a sectional view of FIG. 2 taken substantially on line 3—3 thereof.

DETAILED DESCRIPTION OF CERTAIN EMBODIMENTS OF THE INVENTION

According to the disclosed embodiments of the present invention, there is provided a device and method for setting a golf ball and tee, including a ball and tee receiving member disposed at the bottom end portion of a shaft. A ball engageable member is disposed at the lower end portion of the shaft for pressing the ball against the tee when the ball is received by the receiving member. The receiving member has a lower tee engageable member having a shallow slot opening extending radially in a direction to receive the tee within the slot. A hand engageable lever actuator extends radially from the upper end portion of the shaft in an opposite direction to the opening of the slot for actuating the movable ball engageable member to cause it to move away from the ball. The receiving member has a massive portion disposed substantially below and substantially opposite to the actuator to cause the center of gravity of the device to be disposed offset from the shaft and the slot so that when the device is held by the actuator and the ball engageable member retracts away from the ball, the receiving member tends to swing away from the tee to disengage the tee from the shallow slot.

According to the disclosed embodiments of the invention, a method is provided for setting a tee into the ground with a golf ball on top of it. A device having an upper actuator extending radially from a shaft causes a member to force the ball against the head of the tee. A tee engageable member having a shallow slot disposed below and in alignment with the shaft opens radially in the opposite direction from the actuator. A golf ball is placed on top of a tee and inserted into the device with the ball pressed against the top of the tee. The tee is driven vertically into the ground using the device. The actuator causes the member to retract from the ball and to release it. The tee engageable member is permitted to swing under the force of gravity along an arcuate path of travel away from the tee and toward the user to cause the slot to back away from the tee for freeing the device from the tee and the ball.

Referring now to the drawings, and more particularly to FIG. 1 thereof, there is shown a golf ball and tee setting device 10, which is used to insert a tee 12 into the ground 14 with a golf ball 16 disposed on top of the tee 12. The device 10 generally comprises a tubular shaft 18 having a generally ball and tee receiving member 21 at the bottom end portion of the shaft 18. A ball engageable member 23 is disposed at the lower end portion of the shaft 18 for pressing the ball 16 against the tee 12. The C-shaped receiving member 21 is generally C-shaped, having a pair of arms 22 and 24, extending therefrom and having a lower tee engageable member 25. The member 25 includes a shallow slot 27 opening radially in a direction to receive the tee within the slot 27 to enable the tee 12 to remain in place within the slot during the insertion of the tee into the ground 14.

A hand engageable lever actuator generally indicated at 29 extends radially from the upper end portion of the shaft 18 in an opposite direction to the opening of the slot 27 for actuating the movable ball engageable member 23 to cause it to move away from the ball 16 after the tee 12 has been driven into the ground. The C-shaped member 21 has a massive portion 32 disposed substantially below and substantially opposite to the actuator 29 to cause the overall center of gravity of the device 10 to be disposed offset from the shaft 18 and the slot 27. In this regard, when the device 10 is held by the radial actuator 29 and the ball engageable member 23 retracts away from the ball, the C-shaped member 21 tends to swing away from the tee 12 to disengage the tee from the shallow slot 27. In this manner, after the tee 12 has been driven into the ground 14, the device 10 is readily disengaged from the tee 12 so that the ball 16 tends to remain in place on top of the tee 12.

In use, the ball 16 is placed on top of the tee 12 and the combination of the ball 16 and the tee 12 are then placed into the C-shaped receiving member 21 of the device 10 with the ball pressed against the top of the tee. In this regard, the tee 12 is inserted into the shallow open slot 27, and then the actuator 29 is manipulated by the hand of the user as indicated in broken lines in FIG. 2 to advance the ball engageable member 23 into engagement with the ball 16 to press it firmly against the ball 16 which presses the ball against the head 33 of the tee 12. The head 33 of the tee 12 is then, in turn, pressed against the tee engageable-member 25.

While holding the actuator 29 in one hand, the device 10 is used to drive the tee 12 into the ground 14. After driving the tee 12 into the ground, in order to remove the device 10 from the tee 12 without dislodging the ball 16 from on top of the tee 12 and without requiring the user to bend over at the waist, the actuator 29 is released to permit the ball engageable member 23 to retract upwardly away from the ball 16. Once the pressure is relieved from the top of the ball 16, the off-center weight of the device 10 and its C-shaped receiving member 21, the tee engageable member 25 swings under the force of gravity along a generally arcuate path of travel upwardly away from the tee 12 and toward the user to cause the slot 27 to move away from the tee 12. Thus, the device 10 swings like a pendulum relative to the actuator held by the hand of the user, due to the offset center of gravity. In this regard, due to the shallow depth of the slot 27, the tee engageable member 25 only requires a short swinging motion away from the tee 12 to free the member 25 therefrom. Thus, the device 10 swings a very short distance while being held by one hand of the user from above. In this manner, the user requires little or no effort to move the tee engageable member 25 away from the tee 12.

The device 10 and its C-shaped member 21 is configured to enable the golf ball to be retrieved from the cup or off the ground. In so doing, the stroke of the ball engageable member is such that the ball can be gripped within the C-shaped member while being retrieved.

The shallow slot 27 is generally semi-circular in configuration and is slightly greater than 180°to help retain the tee 12 in engagement therewith, and yet is able to withdraw from the tee 12 freely. Thus, the tee engageable member 25 only moves a short distance before the tee 12 is free from the slot 27 so that the C-7 shaped member 21 can continue to swing away from the ball 16 and the tee 12 in a convenient and easy-to-maneuver manner.

Considering now the actuator 29 in greater detail, the actuator 29 includes a pair of radial handles 34 and 36. The handle 34 is fixed to the top portion of the shaft 18. The handle 36 is moveably mounted relative to the fixed handle 34 as indicated in FIG. 2.

The fixed handle 34 is channel-shaped and includes a bight portion 38 and has a pair of depending L-shaped leg portions 41 and 43. The top portion of the shaft 18 is welded to the underside of the bight portion 38 by means of an annular weld 44 or other suitable techniques such as an adhesive and others. It should be understood that there are various different techniques which may be employed to fix the shafts to the fixed handle 34 as will become apparent to those skilled in the art.

The depending leg portions 41 include a pair of upstanding foot portions 45 and 47 to form a yolk for receiving an end portion of the handle 36 to pivotally attach the end portion of the handle 36 as generally indicated at 49. Thus, as indicated in FIG. 2, the hand of the user can squeeze the handles 34 and 36 toward one another by causing the moveable handle 36 to pivot toward the horizontal fixed handle 34.

A groove 52 is disposed on the underside of the moveable handle 36 and receives a rounded top end 54 of a rod 56 forming a part of the ball engageable member 23. A flared ball receiver 58 is fixed to the bottom end of the rod 56 and has a dished or cupped lower surface (not shown) for engaging the top rounded outer surface of the ball 16 as indicated in FIG. 2. In this regard, when the user grasps the handles 34 and 36 and squeezes them together, the moveable upper handle 36 pivots in a generally counter-clockwise direction as viewed in FIG. 2 to force the rod 56 of the ball engageable member 23 in an axial direction within the tubular shaft 18 to cause the ball receiver 58 at the bottom of the rod 56 to engage the upper surface of the ball 16. In so doing, the top rounded end 54 of the rod 56 rides within the open groove 52 of the handle 36.

A top bearing 61 is disposed at the inside of the shaft 18 at its upper most portion to receive the rod 56 which is slideable mounted inside of the hollow tubular shaft 18. A hole 62 in the bight portion 38 of the handle 34 permits the upper portion of the rod 56 to extend above the handle 34 and into engagement with the slot 52 in the underside of the handle 36. A bearing 63 at the bottom end of the shaft 18 receives the bottom portion of the rod 56 in a slideable engagement.

A spring 65 is compressed between a cross pin 67 fixed to the rod 56 and the bottom bearing 63 to bias the ball engageable member 23 in an open or released position as shown in phantom lines in FIG. 2. In this regard, the hand of the user must manipulate the actuator 29 to cause the rod 56 to move axially downwardly within the shaft 18 to grip the top surface of the ball 16. When it is desired to release the ball and tee from the C-shaped member 21, the user merely relaxes his or her grip on the handles 34 and 36 to cause the spring 65 to expand and cause the rod 56 to rise axially relative to the shaft 18 for retracting the ball receiver 58 from the ball 16. At the same time as the ball 16 is being released by relaxing the tension on the actuator handles, the massive portion 32 of the C-shaped member 21 causes the C-shaped member 21, to swing away from the tee 12 and the ball 16.

In order to enable the device 10 to stand in an upright position after releasing it from the ball and tee, a pointed spike 69 is pivotally attached at 72 to the massive portion 32 of the C-shaped member 21. In this regard, the spike 69 can be pivoted from its storage groove 73 to a downward disposition as indicated in phantom lines in FIG. 2. In this position, the device 10 can be used to drive the spike 69 into the ground 14 to rid the device 10 to be stored into an upright position until it is used again.

A magnet 74 is disposed on the underside of the tee engageable member 25 to serve to help pick-up metal ball markers without a necessity at bending at the waist to pick it up.

Although certain embodiments of the invention have been disclosed in detail for illustration purposes, it will become apparent for those skilled in the art that variations or modifications of the disclosed devices and methods, including the rearrangement of parts, lie within the true spirit and scope of the present invention.

What is claimed is:

1. A device for setting a golf ball and tee, comprising:

a tubular shaft:

a ball and tee receiving member disposed at the bottom end portion of said shaft;

a ball engageable member disposed at the lower end portion of said shaft for pressing the ball against the tee when the ball is received by the receiving member;

said receiving member having a tee engageable member having a shallow slot opening radially in a direction to receive the tee within the slot;

a hand engageable lever actuator extending radially from the upper end portion of said shaft in an opposite direction to the opening of said slot for actuating the moveable ball engageable member to cause it to move away from the ball;

a said C-shaped member having a massive portion disposed substantially below and substantially opposite the actuator to cause the center of gravity of the device to be disposed offset from said shaft and said slot so that when the device is held by the radial actuator and the ball engageable member retracts away from the ball, the receiving member tends to swing away from the tee to disengage the tee from the shallow slot;

wherein said actuator includes a pair of radial handles;

wherein one of said handles is; fixed to said shaft, and the other one of said handles is moveably mounted relative to the fixed handle; and wherein said ball engageable member includes a rod moveably mounted within said tubular shaft and fixed at it top end portion to the moveable handle.

2. A device according to claim 1, wherein said shallow slot is generally semicircular and slightly greater than 180°.

3. A device according to claim 1, wherein said moveable handle includes a groove for receiving the top end of said rod.

4. A device according to claim 1, wherein said receiving member is generally C-shaped.

5. A device according to claim 4, wherein the C-shaped receiving member includes a pair of spaced-apart arms.

* * * * *